US011662693B2

(12) United States Patent
Riedo et al.

(10) Patent No.: US 11,662,693 B2
(45) **Date of Patent: *May 30, 2023**

(54) TOOL FOR ACTUATING A CORRECTOR EQUIPPING A PORTABLE OBJECT OF SMALL DIMENSIONS

(71) Applicant: Montres Breguet S.A., L'Abbaye (CH)

(72) Inventors: Christophe Riedo, Le Lieu (CH); Alain Zaugg, Le Sentier (CH)

(73) Assignee: Montres Breguet S.A., L'Abbaye (CH)

( * ) Notice: Subject to any disclaimer, the term of this patent is extended or adjusted under 35 U.S.C. 154(b) by 106 days.

This patent is subject to a terminal disclaimer.

(21) Appl. No.: 17/332,189

(22) Filed: May 27, 2021

(65) Prior Publication Data

US 2021/0286322 A1 Sep. 16, 2021

Related U.S. Application Data

(63) Continuation of application No. 16/052,783, filed on Aug. 2, 2018, now Pat. No. 11,086,274.

(30) Foreign Application Priority Data

Sep. 7, 2017 (EP) ..... 17189930

(51) Int. Cl.
*G04D 1/02* (2006.01)
*G04D 7/00* (2006.01)
(Continued)

(52) U.S. Cl.
CPC ..... *G04D 1/02* (2013.01); *G04B 3/02* (2013.01); *G04B 27/00* (2013.01); *G04D 1/0042* (2013.01); *G04D 7/00* (2013.01)

(58) Field of Classification Search
CPC ..... G04D 1/02; G04D 1/0042; G04D 7/00; G04B 3/02; G04B 27/00
(Continued)

(56) References Cited

U.S. PATENT DOCUMENTS 237,052 A 1/1881 Schuler
698,732 A 4/1902 Nilson
(Continued)

OTHER PUBLICATIONS

European Search Report dated Mar. 15, 2018 in European Application 17189930.5, filed Sep. 7, 2017 (with English Translation of Categories of Cited Documents).

*Primary Examiner* — Hadi Shakeri
(74) *Attorney, Agent, or Firm* — Oblon, McClelland, Maier & Neustadt, L.L.P.

(57) ABSTRACT

The invention relates to a tool for actuating a push-button corrector equipping a portable object of small dimensions, said actuating tool comprising a body that extends between a rear end defining an area for grasping the actuating tool and a front end defining an area for actuating the actuating tool, the actuating tool further comprising an actuating rod arranged such that it slides in a coaxial manner inside the body, the actuating rod being capable of moving from back to front and from front to back between a retracted rest position wherein it is retracted in a stable manner inside the body of the actuating tool, and a protruding working position wherein it protrudes outside of the cap, the actuating rod remaining in the protruding working position thereof as long as an axial pushing force is exerted thereon, and returns to the retracted rest position thereof as soon as the axial pushing force is released.

6 Claims, 2 Drawing Sheets

(51) Int. Cl.

| | |
|---|---|
| ***G04D 1/00*** | (2006.01) |
| ***G04B 27/00*** | (2006.01) |
| ***G04B 3/02*** | (2006.01) |

(58) Field of Classification Search
USPC ..... 81/6
See application file for complete search history.

(56) References Cited

U.S. PATENT DOCUMENTS

| | | | | | |
|---|---|---|---|---|---|
| 722,559 | A | | 3/1903 | Bond | |
| 798,000 | A | | 8/1905 | Williams | |
| 1,004,755 | A | | 10/1911 | Dunaway | |
| 2,140,465 | A | * | 12/1938 | Bangs | A44C 17/043 29/10 |
| 2,567,580 | A | | 9/1951 | Ruther | |
| 4,595,307 | A | | 6/1986 | Heyden | |
| 6,826,120 | B1 | | 11/2004 | Decker et al. | |
| 7,082,864 | B1 | | 8/2006 | Weber | |
| 9,588,599 | B2 | * | 3/2017 | Fullerton | A63F 13/21 |
| 2014/0168175 | A1 | * | 6/2014 | Mercea | G06F 3/03545 345/179 |

* cited by examiner

TOOL FOR ACTUATING A CORRECTOR EQUIPPING A PORTABLE OBJECT OF SMALL DIMENSIONS

This application is a continuation of and claims priority to U.S. patent application Ser. No. 16/052,783, filed Aug. 2, 2018, which claims priority from European Patent Application No. 17189930.5, filed on Sep. 7, 2017. The benefit of priority is claimed to each of the foregoing, and the entire contents of each of the foregoing are incorporated herein by reference.

TECHNICAL FIELD OF THE INVENTION

This invention relates to a tool for actuating a corrector equipping a portable object of small dimensions, such as a timepiece. The invention more particularly relates to a tool for actuating a push-button of small dimensions, known as a corrector, commonly equipping portable objects such as wristwatches with numerous complications, or smart phones.

TECHNOLOGICAL BACKGROUND OF THE INVENTION

Some watches, in particular so-called watches with numerous complications, offer users so many functions that they cannot all be corrected using a single winding and correcting crown. This is why such watches comprise additional control means such as push-buttons. Different types of push-buttons exist, including miniature push-buttons that are generally embedded in the middle of the watch and that are usually actuated using a pointed instrument. These miniature push-buttons conventionally comprise a socket driven, bonded or screwed into an opening made in the middle of the watch, and a cylindrical control rod capable of sliding freely within the socket. The socket comprises, on the outer side of the watch case, a first cylindrical recess adapted to suit the dimensions of a first portion of the control rod, and on the inner side of the watch case, a second cylindrical recess arranged in the continuation of the first cylindrical recess, whose inner diameter, which is adapted to suit the dimensions of a second portion of the control rod, is less than that of the first cylindrical recess. A water-resistant joint housed in an undercut made on a perimeter of the first portion of the control rod guarantees the water-tight seal between the control rod and the socket. Such a push-button further comprises a helical spring, which is compressed when the user presses on the miniature push-button, and whose return force brings the control rod back to the rest position when the user releases pressure on the push-button.

Push-buttons of the aforementioned type have very small dimensions. Such push-buttons therefore save space. Moreover, they do not project from the middle part and therefore do not risk being actuated by accident. Correction operations take place by driving the control rod into the socket against the return force of the helical spring using a pointed instrument such as a pen. The aforementioned point poses a problem. Indeed, as stated hereinabove, such push-buttons usually equip wristwatches with numerous complications. These are extremely expensive watches, the cases thereof being often made using precious materials. However, the risks of damaging the watch case and of altering the aesthetic appearance thereof when handling a pointed instrument are high, which has become difficult to accept. Of course, there is still the possibility of returning the watch to a workshop for re-polishing, but this is not very convenient.

Push-buttons of the aforementioned type are also used on other portable objects of small dimensions such as smartphones, and the actuation thereof is often used to reset the telephone's electronic circuits.

SUMMARY OF THE INVENTION

The purpose of the present invention is to overcome the aforementioned problems as well as others by providing a tool suitable for use by horologists, but primarily intended for the persons wearing the watches and allowing small push-buttons, also known as correctors, to be actuated without the risk of damaging the middle of the watch case. The tool according to the invention can also be used to actuate the correctors equipping, for example, smartphones and which are used, for example, to reset the telephone's electronic circuits.

To that end, the present invention relates to a tool for actuating a push-button corrector equipping a portable object of small dimensions, said actuating tool comprising a body that extends between a rear end defining an area for grasping the actuating tool and a front end defining an actuating area of the actuating tool, wherein the actuating tool further comprises an actuating rod arranged such that it slides in a coaxial manner inside the body, the actuating rod being capable of moving from back to front and from front to back between a retracted rest position wherein it is retracted in a stable manner inside the body of the actuating tool, and a protruding working position wherein it protrudes outside of the cap, wherein the actuating rod remains in the protruding working position thereof as long as an axial pushing force is exerted thereon, and returns to the retracted rest position thereof as soon as the axial pushing force is released.

According to specific embodiments of the invention:

- the actuating tool further comprises, on the side of the grasping area, a base, and on the side of the actuating area, a cap arranged in a fixed manner on the base, said base and said cap forming the body inside which the actuating rod is arranged such that it slides;
- the actuating tool further comprises a helical spring threaded on the actuating rod and bearing against the cap at a front end, and against a first shoulder formed on the actuating rod at a rear end, the actuating rod being capable of moving against the return force of the helical spring from back to front and from front to back between the retracted rest position thereof and the protruding working position thereof;
- the area for grasping the actuating rod comprises a first cylindrical portion with a first diameter and a second cylindrical portion with a second diameter that is less than the first diameter, the actuating area being formed by a third cylindrical portion with a third diameter that is less than the second diameter, the cap being arranged in a fixed manner on the base and delimiting, with the third cylindrical portion of the actuating rod, a second cylindrical housing inside which the helical spring is positioned in a coaxial manner, the helical spring bearing against the cap at a front end, and against a first shoulder formed on the actuating rod in a connection area between the second cylindrical portion and the third cylindrical portion of said actuating rod at a rear end, the third cylindrical portion projecting from the cap at the front end of the actuating tool and being surrounded by the end portion of the cap, which is also cylindrical.
- the cap is screwed onto the base.

Owing to these features, the present invention provides a tool that allows for the actuation of corrector-type push-buttons, i.e. buttons embedded in a middle of a portable object such as a watch with numerous complications, or a smartphone, without the risk of damaging the middle of the portable object. More specifically, when at rest, the actuating tool is in a situation wherein the front end thereof that defines a portion for actuating a corrector is set back relative to an end portion surrounding it. As a result, when looking to actuate a corrector using the actuating tool according to the invention, said tool is brought close to the corrector and is applied, via the end portion thereof, against the middle of the portable object. At this stage, there is no risk of damaging the middle of the portable object as the actuating portion is set back from the end portion. Then, once the actuating tool is pressed against the middle of the portable object, a slight pushing force is exerted on said tool, which results in projecting the actuating portion of the actuating rod outside of the corrector sleeve surrounding it and allows the corrector to be actuated. Once the corrector has been actuated, the pressure applied to the actuating tool is released, which results in the immediate retraction of the actuating portion of the actuating rod set back from the end portion surrounding it.

According to another advantage of the invention, the guide function of the tool, provided by the end portion that surrounds the tool and that bears against the outer circumference of the push-button corrector, is separated from the actual actuating function of the tool, which is performed by the actuating rod, which significantly eases the positioning and use of the actuating tool.

It is thus understood that the actuating portion that constitutes the active element of the actuating tool moves from a resting state wherein it is retracted inside the actuating tool, to a working state wherein it projects outside of the actuating tool and allows the corrector to be actuated. In this embodiment, the cap is fixed, and the actuating rod, and thus the actuating portion, are capable of moving between a retracted rest position wherein the actuating portion is fully surrounded by an end portion of the cap, and a working position wherein the actuating portion projects from the cap.

BRIEF DESCRIPTION OF THE FIGURES

Other characteristics and advantages of the present invention shall be better understood upon reading the following detailed description of one example embodiment of an actuating tool according to the invention, said example being provided for the purposes of illustration only and not intended to limit the scope of the invention, given with reference to the accompanying drawing, wherein.

DETAILED DESCRIPTION OF ONE EMBODIMENT OF THE INVENTION

The present invention is based on the general inventive idea consisting of providing an actuating tool for actuating a push-button of the corrector type embedded in the middle of a portable object such as a wristwatch with complications or a smartphone, without the risk of damaging the middle which, in particular in the case of wristwatches, is very often made of a precious material. In order to achieve this objective, the present invention concerns using an actuating tool, the active portion thereof being retracted inside the body of said actuating tool in the rest position. The actuating tool can thus be positioned facing the push-button corrector without the risk of damaging the middle of the portable object. Once the tool has been properly positioned facing the push-button corrector, the corrector tool is gently pushed, which allows the active portion to project outside of the body of the actuating tool and correct the push-button corrector.

Figure 1:
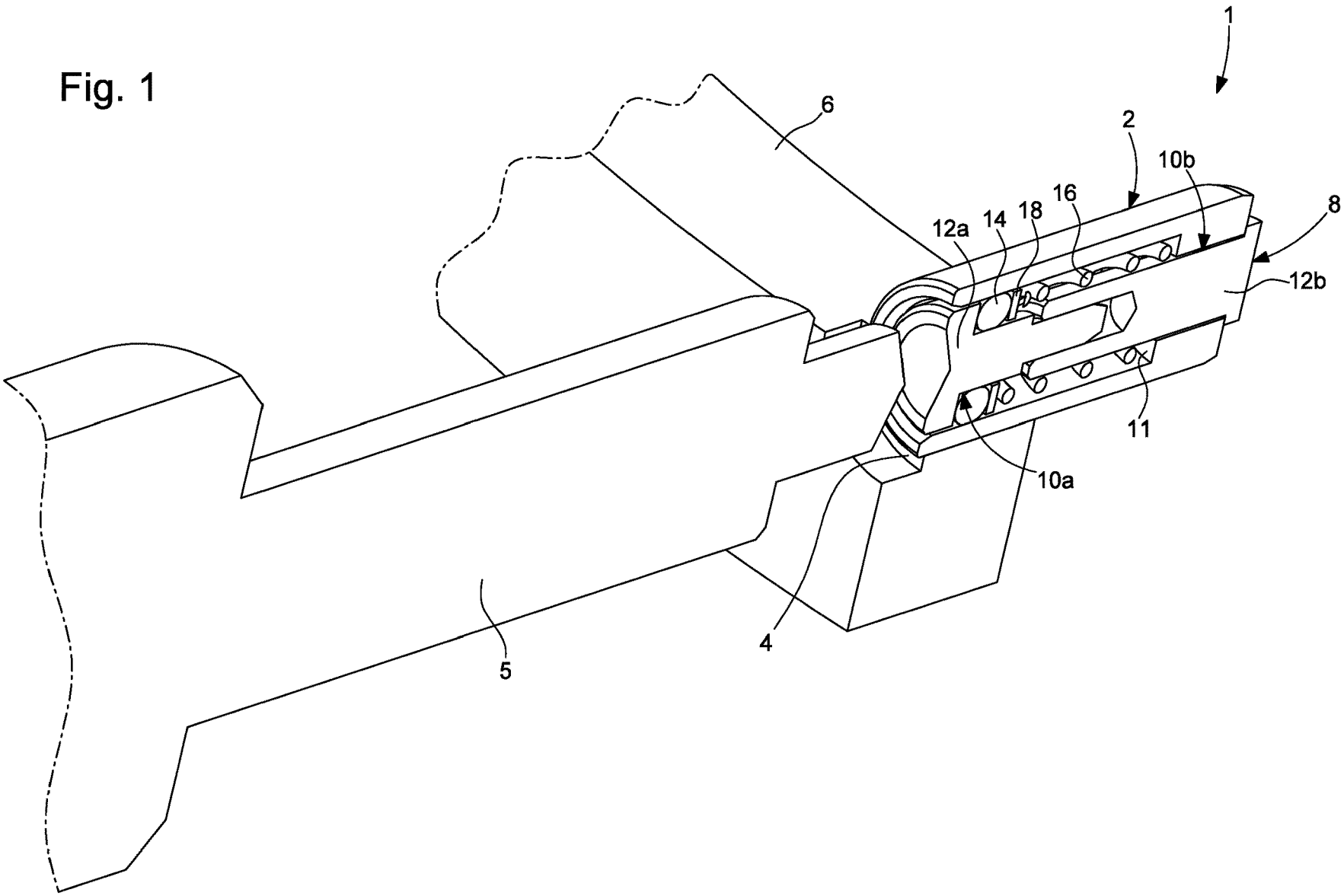
FIG. 1 is a perspective, sectional view of a push-button of the corrector type embedded in a middle of a portable object such as a wristwatch with complications.

FIG. 1 is a perspective view of one embodiment of a push-button of the corrector type, whose actuation can be performed using an actuating tool according to the invention. However, it is understood that the description of such a push-button corrector is provided for the purposes of illustration only and is not intended to limit the scope of the invention. This is a push-button corrector of the conventional type, whose structure does not require any modification or adaptation to suit the structure of the actuating tool according to the invention. Conversely, the characteristics of the push-button correctors do not affect the arrangement of the actuating tool according to the invention.

Designated as a whole by the general reference numeral 1, a push-button of the corrector type conventionally comprises a socket 2, for example driven or bonded inside an opening 4 made in a middle 6 of a portable object, for example a wristwatch, the middle thereof being made from a precious material, or a smartphone. Said push-button corrector 1 can be actuated by the user by means of a pointed instrument 5.

A cylindrical control rod 8 is capable of sliding in the socket 2. For this purpose, the socket 2 comprises a first cylindrical passage 10*a* that opens out onto the outer side of the middle 6 of the portable object and that is adapted to suit the dimensions of a first portion 12*a* of the control rod 8. On the inner side of the middle 6, the socket 2 comprises a second cylindrical passage 10*b* arranged in the continuation of the first cylindrical passage 10*a* and that defines a shoulder 11 inside the socket 2. The inner diameter of said second cylindrical passage 10*b*, adapted to suit the dimensions of a second portion 12*b* of the control rod 8, is less than that of the first cylindrical passage 10*a*. A water-resistant joint 14 housed in an undercut made on a perimeter of the first portion 12*a* of the control rod 8 guarantees the watertight seal between the control rod 8 and the socket 2. Such a push-button corrector 1 further comprises a helical spring 16, which is compressed when the user presses on the push-button corrector 1, and the return force thereof bringing the control rod 8 back to the rest position when the user releases pressure on the push-button corrector 1. The helical spring 16 bears against a washer 18 mounted in a fixed manner on the first portion 12*a* of the control rod 8 at one end, and against the shoulder 11 at the other end.

Push-buttons of the aforementioned type have very small dimensions. They thus save space. Moreover, they do not project from the middle and therefore do not risk being actuated by accident. Such push-buttons often equip top-range watches referred to as having numerous complications. Correction operations take place using a pointed instrument such as a pen. However, the aforementioned point poses a problem. Indeed, wristwatches with complications are extremely expensive watches, the watch cases thereof being often made using precious materials. However, the risks of damaging the watch case and of altering the aesthetic appearance thereof when handling a pointed instrument are high, which has become difficult to accept.

Figure 2A:
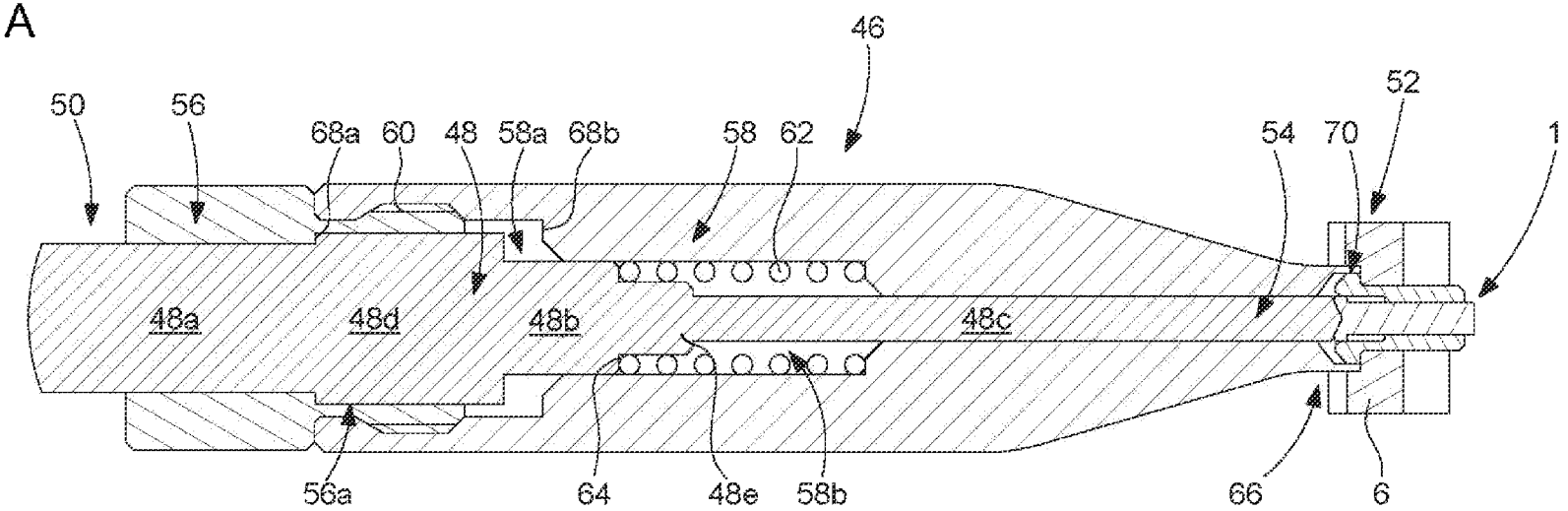
FIG. 2A is a longitudinal, sectional view of an actuating tool according to the invention in the rest position.
Figure 2B:
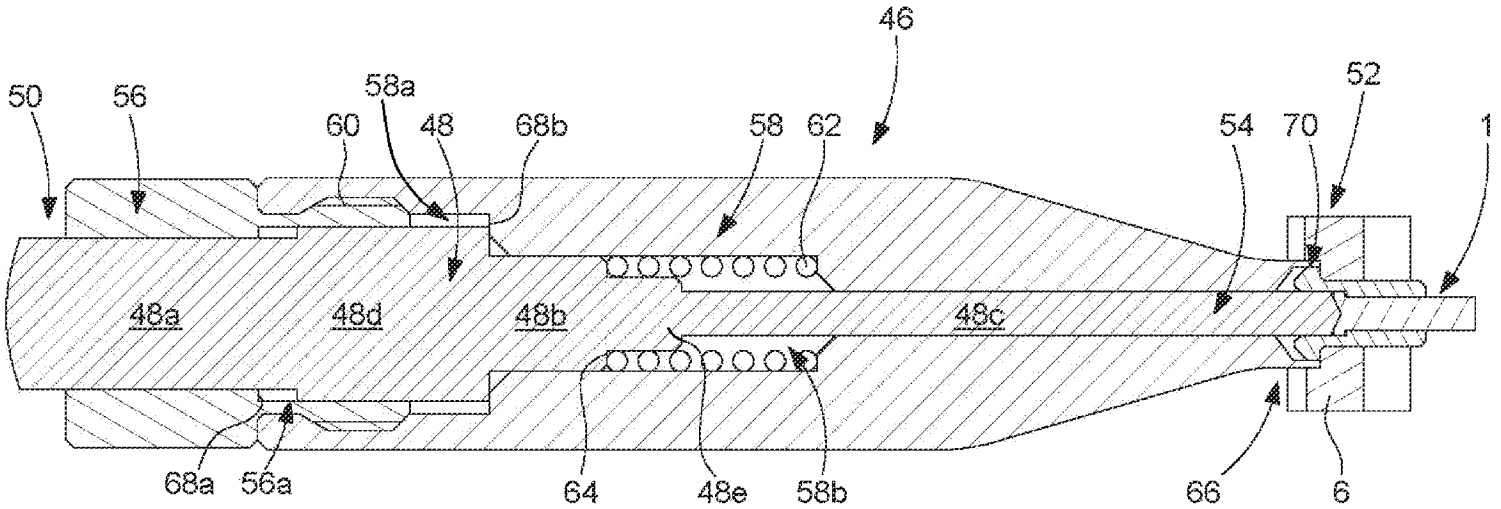
FIG. 2B is a similar view to that in FIG. 2A, wherein the actuating tool is in the working position.

In order to overcome this problem, this invention provides a tool for actuating a push-button corrector, one embodiment thereof being shown in FIGS. 2A and 2B. In these figures, an actuating tool 46 for actuating a push-button corrector 1 equipping a portable object of small dimensions comprises an actuating rod 48 the overall shape thereof being cylindrical, which extends between a rear end 50 defining an area for grasping the actuating tool 46, and a front end 52 defining an area for actuating the actuating tool 46. At the front end thereof, the actuating tool 48 comprises an actuating portion 54 which constitutes the active element of the actuating tool 46 via which the push-button corrector 1 is actuated.

The actuating tool 46 further comprises, on the side of the grasping area, a base 56, and on the side of the actuating area, a cap 58 arranged in a fixed manner on the base 56, for example via a threading 60. The base 56 and the cap 58 form a body inside which the actuating rod 48 is arranged such that it slides in a coaxial manner from back to front and from front to back under the effect of a helical spring 62 threaded on the actuating rod 48 and which bears against the cap 58 at a front end 52, and against a first shoulder 64 formed on the actuating rod 48 at a rear end 50.

More specifically, the actuating rod 48 is capable of moving between a retracted rest position (FIG. 2A) wherein it is forced inwards relative to the body of the actuating tool 46 by the helical spring 62, and a protruding working position (FIG. 2B) wherein it is forced outside of the body of the actuating tool 46 against the elastic force of the helical spring 62. As seen upon examining FIGS. 2A and 2B, an end portion 66 of the cap 58 fully surrounds the actuating portion 54 of the actuating rod 48 in the retracted rest position thereof, whereas said actuating portion 54 projects beyond the end portion 66 of the cap 58 in the protruding working position of the actuating rod 48.

When picking up the actuating tool 46 to actuate the push-button corrector 1, said actuating tool 46 is firstly brought close to the push-button corrector 1 and the end portion 66 of the cap 58 is applied against the middle 6 of the portable object (FIG. 2A). Then, under the effect of the pushing force exerted on the actuating rod 48, said actuating rod 48 slides axially inside the body formed by the base 56 and the cap 58 and presses against the control rod 8 of the push-button corrector 1.

During the relative displacement of the actuating rod 48 with regard to the cap 58, the actuating portion 54 of the actuating rod 48 projects beyond the end portion 66 of the cap 58 and moves to the protruding working position, which allows the push-button corrector 1 to be actuated. In order to reach the protruding working position thereof, the actuating rod 48 moves against the elastic return force of the helical spring 62, which is compressed. When the correction has been made, the actuating tool 46 is moved away from the middle 6 of the portable object, which allows the helical spring 62 to expand and push the cap 58 back into the rest position thereof, wherein the end portion 66 thereof again fully surrounds the actuating portion 54 of the actuating rod 48.

According to one specific embodiment of the invention shown in FIGS. 2A and 2B, the actuating rod 48 comprises a first cylindrical portion 48*a* with a first diameter, and a second cylindrical portion 48*b* with a second diameter that is less than the first diameter. The actuating portion 54 is formed by a third cylindrical portion 48*c* with a third diameter that is less than the second diameter.

As shown in the figures, the first cylindrical portion 48*a* of the actuating rod 48 has a local first increase in diameter 48*d* that is adjusted to the inner diameter of a first cylindrical housing 56*a* made in the outer threaded part of the base 56. This allows the actuating rod 48 to be guided in axial sliding. The first cylindrical housing 56*a* is extended by a second cylindrical housing 58*a* made in the cap 58 in the area at which said cap 58 is screwed onto the base 56. Said second cylindrical housing 58*a* has a diameter that is greater than that of the first cylindrical housing 56*a* and is extended by a third cylindrical housing 58*b*, and the inner diameter of the third cylindrical housing 58*b* is less than that of the first cylindrical housing 56*a* and is adjusted to the outer diameter of the second cylindrical portion 48*b*, which also allows the actuating rod 58 to be guided axially. It is thus understood that by joining the base 56 and the cap 58, the first cylindrical housing 56*a* and the second cylindrical housing 58*a* jointly form a cavity of larger dimensions, delimited by a second shoulder 68*a* and a third shoulder 68*b* separated by a distance that defines the maximum travel of the actuating rod 48.

Finally, the third cylindrical portion 48*c* is seen to have a second increase in diameter 48*e* in the area at which it is connected to the second cylindrical portion 48*b*. Said second increase in diameter 48*e* ensures the axial guidance of the helical spring 62 and delimits, with the second cylindrical portion 48*b*, the first shoulder 64 against which the helical spring 62 abuts.

It is evident that this invention is not limited to the embodiment described above and that various simple alternatives and modifications can be considered by one of ordinary skill in the art without leaving the scope of the invention as defined by the accompanying claims. It should in particular be noted that, according to one embodiment of the invention, at least the end of the actuating portion 54 of the actuating rod 48 will be coated in a layer of a material that is not as hard as the material of which the middle 6 of the portable object is made, for example. It should also be noted that the head of the push-button correctors is often surrounded by a circular groove 70 (see FIGS. 2A and 2B) machined in the middle 6 of the portable object. According to one advantageous embodiment of the invention, the diameter of the end portion 66 will correspond to the diameter of the circular groove 70.

NOMENCLATURE

1. Push-button corrector
2. Socket
4. Opening
5. Pointed instrument
6. Middle
8. Control rod
10*a*. First cylindrical recess
10*b*. Second cylindrical recess
11. Shoulder
12*a*. First portion
12*b*. Second portion
14. Water-resistant joint
16. Helical spring
18. Washer
46. Actuating tool
48. Actuating rod
48*a*. First cylindrical portion
48*b*. Second cylindrical portion
48*c*. Third cylindrical portion
48*d*. First increase in diameter
48*e*. Second increase in diameter
50. Rear end

52. Front end
54. Actuating portion
56. Base
56*a*. First cylindrical housing
58. Cap
58*a*. Second cylindrical housing
58*b*. Third cylindrical housing
60. Threading
62. Helical spring
64. First shoulder
66. End portion
68*a*. Second shoulder
68*b*. Third shoulder
70. Circular groove

What is claimed is:

1. A watch and an actuating tool that actuates a push-button corrector of the watch, wherein said actuating tool comprises a body that extends between a rear end defining an area for grasping the actuating tool and a front end defining an area for actuating the actuating tool, said body ending in a cap, wherein the actuating tool further comprises an actuating rod arranged such that it slides in a coaxial manner inside the body, the actuating rod being capable of moving from back to front and from front to back between a retracted rest position wherein it is retracted in a stable manner inside the body of the actuating tool, and a protruding working position wherein it protrudes outside of an end position of the cap, wherein the actuating rod remains in the protruding working position thereof as long as an axial pushing force is exerted thereon, and returns to the retracted rest position thereof as soon as the axial pushing force is released, wherein the actuating tool comprises, on the side of the grasping area, a base, and on the side of the actuating area, the cap arranged in a fixed manner on the base, wherein said base and said cap form the body inside which the actuating rod is arranged such that the actuating rod slides between the retracted rest position, in which the actuating rod abuts the cap to prevent further movement to the back, and the protruding working position, in which the actuating rod abuts the base to prevent further movement to the front.

2. The watch and the actuating tool according to claim 1, wherein the actuating tool comprises a helical spring threaded on the actuating rod and bearing against the cap at a front end, and against a first shoulder formed on the actuating rod at a rear end, wherein the actuating rod is capable of moving against the return force of the helical spring from back to front and from front to back between the retracted rest position thereof and the protruding working position thereof.

3. The watch and the actuating tool according to claim 2, wherein the actuating rod comprises, on the side of the grasping area, a first cylindrical portion with a first diameter and a second cylindrical portion with a second diameter that is less than the first diameter, and on the side of the actuating area, a third cylindrical portion with a third diameter that is less than the second diameter, wherein the cap is arranged in a fixed manner on the base and delimits, with the third cylindrical portion of the actuating rod, a third cylindrical housing inside which the helical spring is positioned in a coaxial manner, wherein the helical spring bearings against the cap at a front end, and against a first shoulder formed on the actuating rod in a connection area between the second cylindrical portion and the third cylindrical portion of said actuating rod at a rear end, the third cylindrical portion projecting from the cap at the front end of the actuating tool and being surrounded by an end portion of the cap, which is also cylindrical.

4. The watch and the actuating tool according to claim 3, wherein the cap is screwed onto the base.

5. The watch and the actuating tool according to claim 1, wherein an end of the actuating portion of the actuating rod is coated in a layer of a material that is not as hard as the material of which the watch is made.

6. The watch and the actuating tool according to claim 1, wherein the push-button corrector is surrounded by a circular groove machined in the watch, a diameter of an end portion of the cap corresponding to the diameter of the circular groove.

* * * * *